US011633747B2

(12) United States Patent
Duquet

(10) Patent No.: US 11,633,747 B2
(45) Date of Patent: Apr. 25, 2023

(54) HEAD FOR DISPENSING FLUID MATERIAL

(71) Applicant: APTAR FRANCE SAS, Le Neubourg (FR)

(72) Inventor: Frédéric Duquet, Crespières (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/465,272

(22) PCT Filed: Dec. 1, 2017

(86) PCT No.: PCT/FR2017/053344
§ 371 (c)(1),
(2) Date: May 30, 2019

(87) PCT Pub. No.: WO2018/100321
PCT Pub. Date: Jun. 7, 2018

(65) Prior Publication Data

US 2019/0388910 A1 Dec. 26, 2019

(30) Foreign Application Priority Data

Dec. 2, 2016 (FR) ..... 1661845

(51) Int. Cl.
*B05B 1/14* (2006.01)
*B05B 7/08* (2006.01)
(Continued)

(52) U.S. Cl.
CPC ..... *B05B 1/14* (2013.01); *B05B 1/26* (2013.01); *B05B 7/0892* (2013.01); *B05B 11/30* (2013.01);
(Continued)

(58) Field of Classification Search
CPC ..... B05B 1/14; B05B 7/0892; B05B 11/30; B65D 83/753
(Continued)

(56) References Cited

U.S. PATENT DOCUMENTS 2,428,292 A * 9/1947 Queen ..... B05B 13/0627 118/306
3,606,618 A * 9/1971 Veech ..... A47K 3/325 4/603
(Continued)

FOREIGN PATENT DOCUMENTS

EP 1 878 507 A2 1/2008
EP 2 390 010 A1 11/2011
(Continued)

OTHER PUBLICATIONS

International Preliminary Report on Patentability dated Mar. 28, 2019, in counterpart International Application No. PCT/FR2017/053344.
(Continued)

*Primary Examiner* — Chee-Chong Lee
(74) *Attorney, Agent, or Firm* — Sughrue Mion, PLLC

(57) ABSTRACT

A fluid dispenser head (T) including a spray wall (26) that is perforated with a network of holes (O) through which the fluid under pressure passes so as to be sprayed in small droplets;
the dispenser head being characterized in that the network of holes (O) comprises at least two series of holes (O), with the holes (O) of a given series presenting holes that are substantially identical in size, and with the holes (O) of different series presenting holes that are different in size, such that one series of holes (O) generates a spray of small droplets with droplet sizes that define a first Gaussian distribution, while another series of holes (O) generates a spray of small droplets with droplet sizes that define a second Gaussian
(Continued)

distribution that is offset relative to the first Gaussian distribution, thus producing a complex spray having at least two distinct Gaussian distributions.

23 Claims, 4 Drawing Sheets

(51) Int. Cl.
*B05B 11/00* (2023.01)
*B65D 83/14* (2006.01)
*B05B 1/26* (2006.01)

(52) U.S. Cl.
CPC ..... *B05B 11/3042* (2013.01); *B65D 83/753* (2013.01)

(58) Field of Classification Search
USPC ..... 239/548
See application file for complete search history.

(56) References Cited

U.S. PATENT DOCUMENTS 3,724,403 A * 4/1973 Frantzen ..... F24H 9/2007 110/189
4,490,411 A * 12/1984 Feder ..... C23C 24/10 427/543
4,668,852 A * 5/1987 Fox ..... B05B 7/224 219/76.14
5,004,158 A * 4/1991 Halem ..... B05B 1/18 137/564.5
5,080,056 A * 1/1992 Kramer ..... F02F 7/0007 123/193.4
5,294,054 A * 3/1994 Benedict ..... B05B 1/1645 239/222.15
5,476,225 A * 12/1995 Chan ..... B05B 1/1636 239/449
6,161,780 A * 12/2000 Sugimoto ..... F02M 61/1806 239/533.12
2015/0211728 A1 7/2015 Zhadanov et al.
2016/0059243 A1* 3/2016 Parisi-Amon ..... B05B 1/18 239/444
2016/0339457 A1 11/2016 Hou
2017/0280852 A1* 10/2017 Kang ..... A45D 40/222

FOREIGN PATENT DOCUMENTS

FR 2 903 328 A1 1/2008
JP 2002-186882 A 7/2002
WO 02/090762 A1 11/2002
WO 2016/036228 A1 3/2016
WO 2016/099158 A1 6/2016

OTHER PUBLICATIONS

International Search Report of PCT/FR2017/053344 dated Mar. 7, 2018 [PCT/ISA/210].

* cited by examiner

HEAD FOR DISPENSING FLUID MATERIAL

CROSS REFERENCE TO RELATED APPLICATIONS

This application is a National Stage of International Application No. PCT/FR2017/053344, filed Dec. 1, 2017, claiming priority to French Patent Application No. 1661845, filed Dec. 2, 2016.

The present invention relates to a fluid dispenser head for associating with a dispenser member, such as a pump or a valve. The dispenser head may be integrated in, or mounted on, the dispenser member. The dispenser head may include a bearing surface such that it constitutes a pusher on which the user presses so as to actuate the dispenser member. In a variant, the dispenser head need not have a bearing surface. This type of fluid dispenser head is frequently used in the fields of perfumery, cosmetics, or even pharmacy.

A conventional dispenser head, e.g. of the pusher type, comprises:

an inlet well for connecting to an outlet of a dispenser member, such as a pump or a valve;

an axial assembly housing in which there extends a pin defining a side wall and a front wall; and a cup-shaped nozzle comprising a substantially-cylindrical wall having an end that is closed by a spray wall that forms a spray orifice, the nozzle being assembled along an axis X in the axial assembly housing, with its cylindrical wall engaged around the pin, and its spray wall in axial abutment against the front wall of the pin.

In general, the inlet well is connected to the axial assembly housing via a single feed duct. In addition, it is common to form a swirl system in the spray wall of the nozzle. A swirl system conventionally comprises a plurality of tangential swirl channels that open out into a swirl chamber that is centered on the spray orifice of the nozzle. The swirl system is disposed upstream from the spray orifice.

Document FR 2 903 328 A1 describes several embodiments of a nozzle including a spray wall that is perforated with a plurality of spray holes that are substantially or completely identical in diameter, lying in the range about 1 micrometer (μm) to 100 μm, with a tolerance of 20%. Such a spray wall generates a spray having a droplet size that is relatively uniform.

However, for certain fluids, in particular in the field of perfumery, it turns out to be advantageous for the spray to present a distribution of droplet sizes that is more complex, i.e. less uniform overall, making it possible to perform a plurality of specific and clearly distinct functions. For example, for a fluid containing a fragrance, such as a perfume, it is advantageous for the spray to ensure both that droplets are deposited on the user's skin, and also that olfactory compounds are dispersed in the air as a result of the rapid evaporation of the solvent portion from very small droplets. The deposit of droplets on the user's skin must be perceived by the user so that the user is sure that the perfume has reached the target, and this perception giving rise to a sensation of moisture or of "wetness" on the skin. The dispersion of the olfactory compounds enables the user to smell or to inhale the top (or "head") note of the fragrance so that the user is sure of its effectiveness. Thus, these two perceptions, tactile and olfactory, must be provided by a single spray. This happens with most perfume dispensers, but not in optimum manner. With conventional dispensers having a swirl chamber and dispenser orifice lying in the range 200 μm to 300 μm in diameter, an average but acceptable result is obtained, as a result of them generating sprays with a non-uniform droplet size distribution that is centered on approximately 55 μm, with 90% of the droplets lying in the range 30 μm to 80 μm, and with droplets up to 300 μm at the start and/or at the end of spraying. With a dispenser fitted with a pusher as disclosed in document FR 2 903 328 A1, a result is obtained that is clearly insufficient, because the droplets are uniform in size: the tactile perception is thus good, while the olfactory perception is non-existent, or vice versa.

In the field of administering fluids orally, it may turn out to be advantageous to have a spray that makes it possible to perform a plurality of specific and clearly distinct functions. For example, a fluid can be adapted to treat several distinct targets (the oral cavity and the pharynx, or the pharynx and the larynx, or the larynx and the trachea, or the trachea and the lungs, or possibly different segments of the lungs, etc.). To reach their targets, the droplets must penetrate into the patient's respiratory system to a greater or lesser extent. With conventional dispensers, an average but acceptable result is obtained, as a result of them generating sprays with a non-uniform droplet size distribution that lies in the range 30 μm to 80 μm. With a dispenser fitted with a pusher as disclosed in document FR 2 903 328 A1, a result is obtained that is clearly insufficient, because the droplets are uniform in size: one target is thus reached well, while the other target(s) remain inaccessible, or vice versa.

The problem of the invention, namely to perform a plurality of specific and clearly distinct functions with a single spray, is found in perfumery and in inhalation as described above, but also in other fields in which a multi-function spray is advantageous.

To achieve this object, the present invention proposes a fluid dispenser head including a spray wall that is perforated with a network of holes through which the fluid under pressure passes so as to be sprayed in small droplets; the dispenser head being characterized in that the network of holes comprises at least two series of holes, with the holes of a given series presenting holes that are substantially identical in size, and with the holes of different series presenting holes that are different in size, such that one series of holes generates a spray of small droplets with droplet sizes that define a first Gaussian distribution, while another series of holes generates a spray of small droplets with droplet sizes that define a second Gaussian distribution that is offset relative to the first Gaussian distribution, thus producing a complex spray having at least two distinct Gaussian distributions.

Instead of having a broad and non-uniform distribution of droplet sizes as with conventional dispensers, or a narrow and uniform distribution of droplet sizes as with the dispenser in document FR 2 903 328 A1, the nozzle of the invention obtains a distribution of droplet sizes that is complex with two (or more) Gaussian distributions that are relatively narrow, uniform, and above all separate and clearly distinct, making it possible to reach different targets so as to perform different functions.

Advantageously, a series of holes of larger size is arranged around a series of holes of smaller size. With this configuration, the smaller droplets are surrounded, guided, and/or channeled by the bigger droplets. For perfume, the moistening (wetting) aspect is enhanced relative to the olfactory aspect. Conversely, a series of holes of smaller size may be arranged around a series of holes of larger size. In this configuration, the olfactory aspect is enhanced relative to the moistening (wetting) aspect.

In another advantageous arrangement, the series of holes are arranged in concentric rings. In a variant the series of holes present an arrangement that is generally polygonal.

In another advantageous arrangement, the spray wall defines an upper zone and a lower zone, the series of smaller-size holes extends mainly in the upper zone, while the series of larger-size holes extends mainly in the lower zone. This particular arrangement is advantageous with a perfume dispenser as a result of the smaller droplets being situated above the bigger droplets, such that the droplets that are smaller, and as a result that are more volatile, may be dispersed easily and rapidly into the air, while the droplets that are bigger, and as a result that are wetter, reach the skin directly without being disrupted by the smaller droplets.

In a variant, the series of holes may be interleaved in substantially uniform manner. With this configuration, the droplets of different sizes are mixed together intimately, potentially reducing their specific characteristics, but producing a spray that is more uniform visually.

In very general manner, the size of the holes of the series of holes may lies in the range about 1 μm to 100 μm, advantageously in the range about 5 μm to 30 μm, and preferably in the range about 10 μm to 20 μm. Each series of holes comprises at least five holes (O) that are substantially identical in size. In addition, the sizes of the holes of different series differ by at least 30%.

For spraying fluid that contains a fragrance, the size of the holes of the series of smaller-size holes may lie in the range about 5 μm to 15 μm, and the size of the holes of the series of larger-size holes may lie in the range about 15 μm to 30 μm. Following various studies carried out with fragrance professionals and with users, it has been observed specifically that the size of perfume droplets generated during spraying is very important for the effectiveness of scenting and also for the quality perceived by the user. A small size (lying in the range 10 μm to 30 μm) enables the solvent phase to evaporate rapidly and, as a result, reveals the top notes of the perfume very clearly, which is very positive for the user. However, that small size does not enable the fragrance to be properly conveyed to the user. This was observed in the context of studies carried out on piezoelectric sprays in the late 2000s. The rapid evaporation of the fragrance after spraying produces a 'dry' spray that scents the environment more than the person that uses it. A bigger size, such as the size generated by present-day pumps fitted with a swirl nozzle (Gaussian distribution centered on ±55 μm), produces a wetter spray that conveys the fragrance and its core notes well, but reveals the top notes less.

With the dispenser head of the invention, a spray is produced in which the size distribution is not a broad Gaussian distribution, but rather a superposing of two (or more) quite narrow Gaussian distributions that are centered on distinct values (e.g. 30 μm and 50 μm).

In addition, it has also been found during technical studies on characterizing piezoelectric type sprays, that as a result of their small inertia, particles that are too small tend to swirl rapidly, causing the outline of the cone of spray to be disturbed and very subject to disturbances from the surrounding air. This is why it is sometimes advantageous to generate greater-diameter particles at the periphery of the spray cone, and smaller-diameter particles at the core of the cone. This makes it possible to reduce the effects of turbulence, and to obtain a spray that is better controlled. By way of example only, one possible configuration could be forty holes of 10 μm in the central portion, and ten holes of 15 μm in the outer ring.

In a practical embodiment that is conventional in the fields of perfumery, cosmetics, and sometimes pharmacy, the dispenser head comprises:

an inlet well for connecting to an outlet of a dispenser member, such as a pump or a valve;

an axial assembly housing;

a feed duct that connects the inlet well to the axial assembly housing; and a nozzle including an assembly wall that is engaged in the axial assembly housing, the spray wall being secured to the nozzle.

Advantageously, the assembly wall is overmolded on the spray wall.

The spirit of the invention resides in making, in a single dispenser or spray wall, groups of holes of sizes that are different so as to generate sprays that are distinct while nevertheless being superposed, adjacent, surrounded, interleaved, or even interlaced, during dispensing.

The invention is described more fully below with reference to the accompanying drawings, which show several embodiments of the invention as non-limiting examples.

Figure 1:
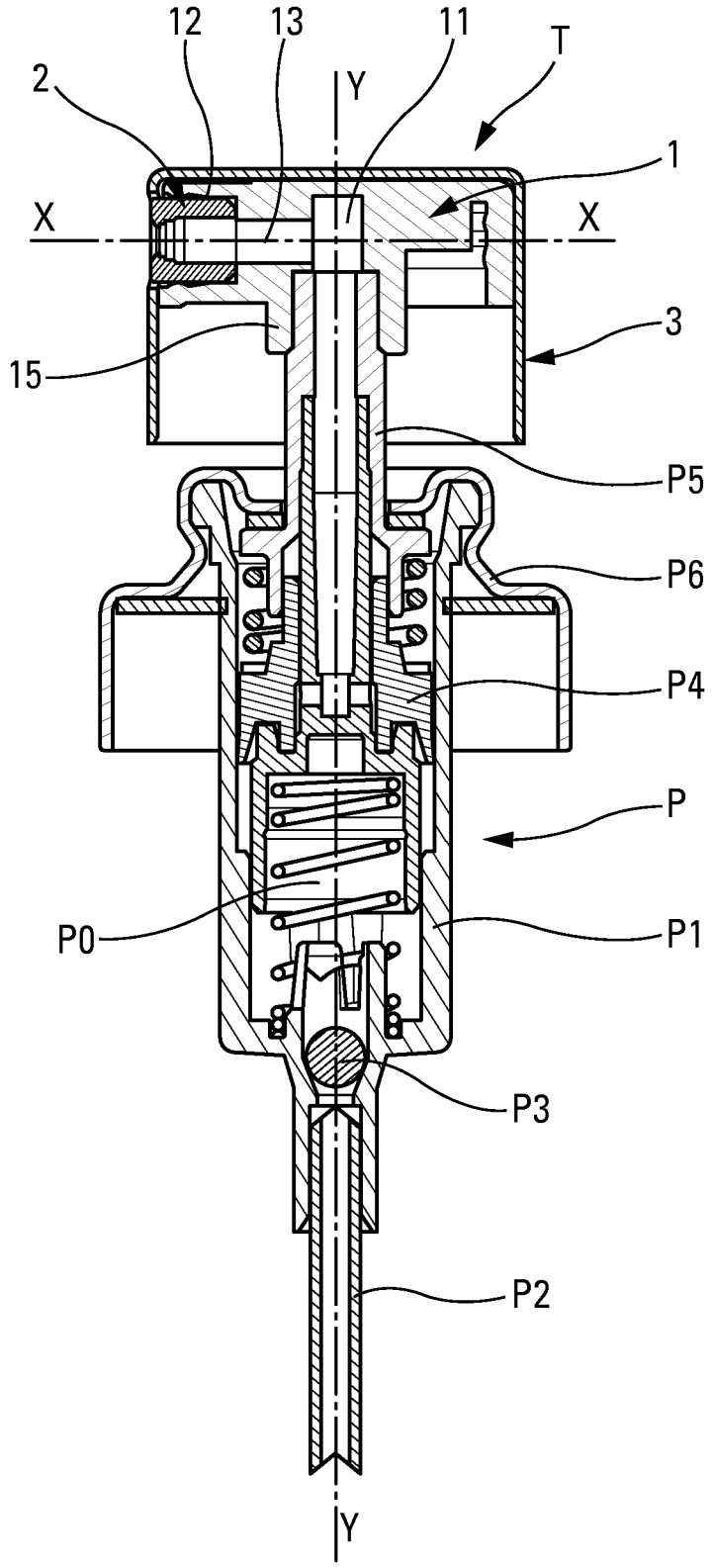
FIG. 1 is a vertical section view through a pump fitted with a dispenser head of the invention.
Figure 2:
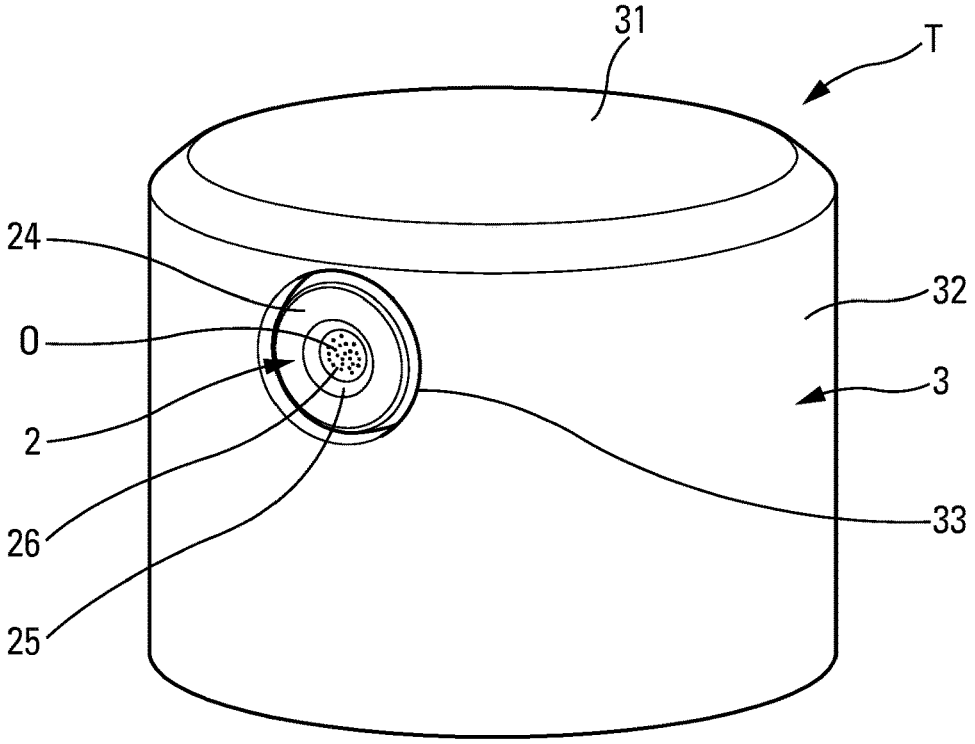
FIG. 2 is a perspective view of the FIG. 1 dispenser head.

In FIG. 1, the dispenser head T is mounted on a dispenser member P, such as a pump or a valve, that presents a design that is entirely conventional in the fields of perfumery and pharmacy. The dispenser member P is actuated by the user pressing axially on the head T with a finger, in general the index finger.

For a pump, the normal pressure generated by pressing axially on the fluid inside the pump P and the head T lies in the range about 5 bars to 6 bars, and preferably in the range about 5.5 bars to 6 bars. Peaks lying in the range 7 bars to 8 bars are nevertheless possible, but in conditions of use that are abnormal. Conversely, when approaching 2.5 bars, the spray is degraded, in the range 2.5 bars to 2.2 bars the spray is significantly degraded, and below 2 bars there is no longer any spray.

For an aerosol fitted with a valve, the initial pressure generated by the propellant gas lies in the range about 12 bars to 13 bars and then drops to approximately 6 bars as the aerosol empties. An initial pressure of 10 bars is common in the fields of perfumery and cosmetics.

When the assembly comprising the head (T) and a pump or valve is mounted on a fluid reservoir, the resulting fluid dispenser is entirely manual, without requiring any supply of power, in particular of electrical power.

In comparison, in the technical field of ultrasonic-vibration spray devices (in particular piezoelectric spray devices), the pressure of the fluid at the nozzle is about 1 bar, i.e. atmospheric pressure, or a little less. Given the pressure values and the power used by such ultrasonic-vibration spray devices, they lie outside the scope of the invention.

Reference is made to FIGS. 1 to 6 taken together in order to describe in detail the component parts of a dispenser head T made in accordance with the invention, and how they are arranged relative to one another.

The dispenser head T comprises two essential component parts, namely a head body 1 and a nozzle 2. The two parts can be made by injection-molding plastics material. The head body 1 is preferably made as a single part: however, it could be made from a plurality of parts that are assembled together. The same applies for the nozzle 2 that may be made as a single part out of a single material, or by overmolding or by bi-injection, possibly with a subsequent reworking operation.

Figure 3:
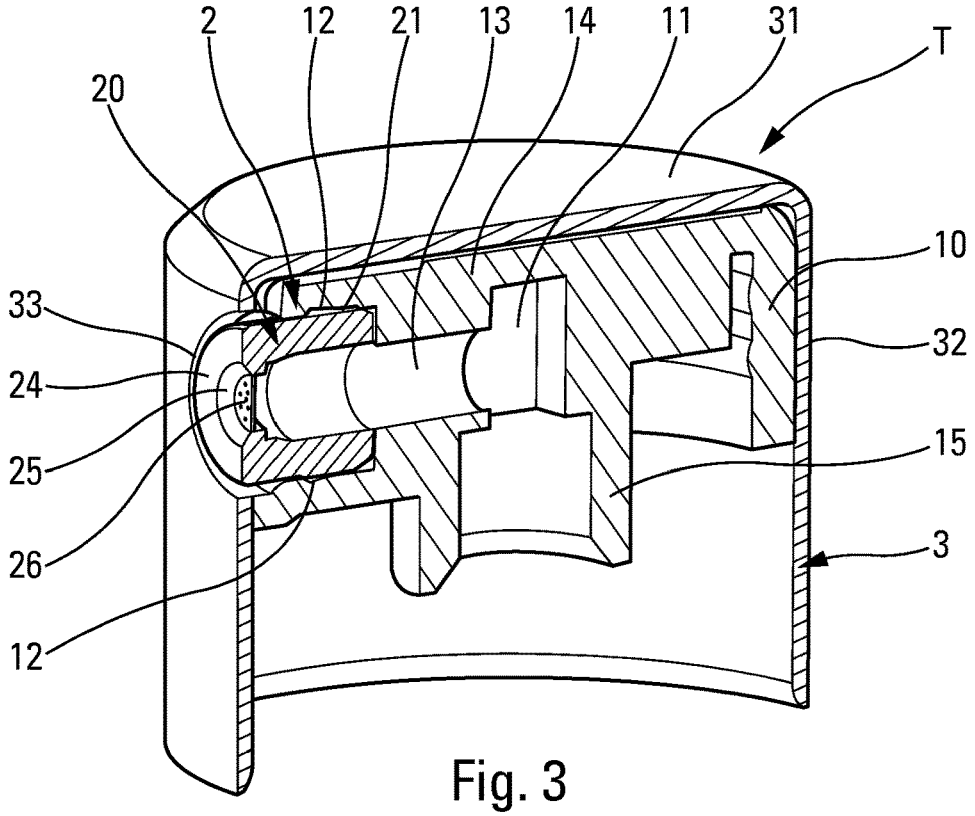
FIG. 3 is a vertical section view through the dispenser head in FIGS. 1 and 2.
Figure 4:
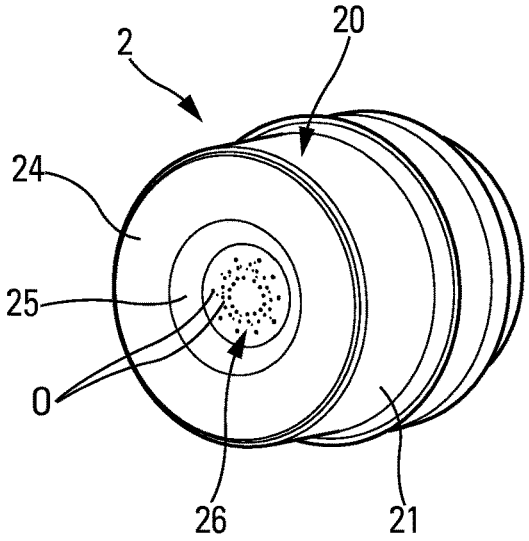
FIG. 4 is a larger-scale perspective view of the nozzle in FIGS. 1 to 3.
Figure 5:
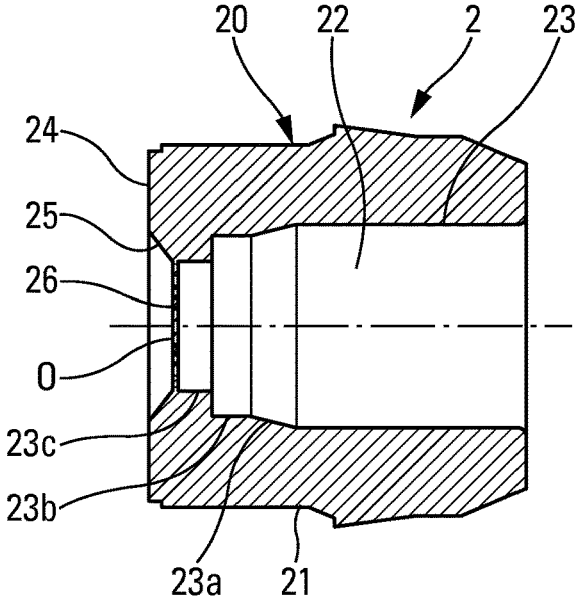
FIG. 5 is a larger-scale vertical section view through the FIG. 4 nozzle.

The head body 1 includes a substantially-cylindrical peripheral skirt 10 that is closed at its top end by a disk 14. The head body 1 also includes a connection sleeve 15 that, in this embodiment, extends in coaxial manner inside the peripheral skirt 10. The connection sleeve 15 extends downwards from the disk 14. The inside of the connection sleeve defines an inlet well 11 that is open at its bottom end, and that is closed at its top end by the disk 12. The connection sleeve 15 is for mounting on the free end of an actuator rod P5 of the dispenser member P. The actuator rod P5 is movable downwards and upwards along the axis Y. The actuator rod P5 is hollow so as to define a flow duct that is in communication with a metering chamber P0 of the pump P or the valve. The inlet well 11 extends upwards, extending the actuator rod P5 so that the fluid coming from the metering chamber P0 can flow into the inlet well 11. The head body 1 also defines a feed duct 13 that connects the inlet well 11 to an assembly housing 12, as can be seen in FIGS. 1 and 3. The axial assembly housing 12 is of generally cylindrical configuration, thereby defining an inside wall that is substantially cylindrical. The feed duct 13 opens out into the assembly housing 2 in central manner. It should also be observed that the inside wall of the assembly housing 12 presents fastener profiles enabling the nozzle 2 to be held more securely, as described below.

Optionally, the head body 1 may be engaged in a cover 3 that comprises a top bearing surface 31 on which a finger can press, and a side casing 32 that forms a side opening 33 through which the nozzle 2 can pass.

The nozzle 2 presents a configuration that is generally substantially conventional, in the form of a cup that is open at one end and closed at its opposite end by a spray wall 26 in which a plurality of spray holes or orifices O are formed. More precisely, the nozzle 2 comprises a nozzle body 20 of shape that is generally substantially cylindrical and that is preferably circularly symmetrical about an axis X, as shown in FIG. 1. In other words, the nozzle 2 does not need to be oriented angularly, prior to being presented in front of the inlet of the axial assembly housing 12. The nozzle body 20 forms an outer assembly wall 21 that is advantageously provided with fastener portions in relief that are suitable for co-operating with the fastener profiles of the assembly housing 12. Thus, the nozzle 2 can be engaged axially without any particular orientation in the axial assembly housing 12, as shown in FIG. 1. Once axial assembly has been completed, the nozzle 2 is in the configuration shown in FIGS. 1 and 3.

The inside of the nozzle body 20 forms a chamber 22 that is defined by an inside wall 23 of configuration that is generally substantially cylindrical, although it forms a frustoconical section 23*a* and two small cylindrical sections 2*b* and 23*c*. On its outer front face, the nozzle body 20 forms a plane annular flat 25 in which a guide cone 25 is formed.

The spray wall 26 is secured to the nozzle body 20, advantageously where the small cylindrical section 23*c* meets the guide cone 25. The spray wall 26 is fastened to the nozzle body 20 by any means, such as by overmolding, by bi-injection, by molding as a single part made of a single material, by snap-fastening, by crimping, by rolling, etc.

The spray wall 26 may be a single-piece part made of a single material, an assembly of a plurality of parts, or a multilayer structure, e.g. a laminate. It can be made of metal, plastics material, ceramic, glass, or a combination thereof. More generally, any material that is suitable for being perforated with small holes or orifices can be used. The thickness of the spray wall 26 where the holes O are formed lies in the range about 10 μm to 100 μm. The number of holes O lies in the range about 30 to 500. Its thickness may be constant, or in contrast it may vary. The diameter of the spray wall 26 where the holes O are formed lies in the range about 0.5 millimeters (mm) to 5 mm. The spray wall 26 may be completely plane on one or both of its faces, or in contrast it may be convex, preferably towards the outside. Alternatively, it may be plane in part and convex in part, e.g. at its center. The convex shape of the wall 26 may be made after the holes O have been perforated, or in contrast before they have been perforated. The orientation of the holes O may be identical, e.g. parallel to the axis X, or in contrast their orientations may diverge, in particular when the wall 26 is convex. The density of the holes O over the wall 26 may be uniform, or in contrast it may be non-uniform, e.g. increasing or decreasing from the center of the wall.

In an advantageous method of manufacture, the holes O are perforated in the spray wall 26 while it is already secured to the nozzle body 20. Thus, the nozzle body 20 may be used as a holder for holding the spray wall 26 while it is being perforated, which may be done by laser, for example. It should be kept in mind that the spray wall 26 is a very small part, and as a result is difficult to handle. It should be observed that perforating the holes O with the spray wall 26 pre-mounted on the nozzle body 20 is a method that may be implemented regardless of the size of the holes O, i.e. regardless of the fact that the holes are of different sizes.

Specifically, in the invention, the spray holes or orifices O form a network of holes comprising two series 27, 28 of holes O of different sizes, with the holes O of a single series 27 or 28 presenting hole sizes that are identical, ignoring manufacturing tolerances, which do not exceed 10%. Thus, for a spray wall 26 perforated with one hundred holes O, it is possible to have a first series 28 of fifty holes O each having a diameter of 10 μm, and a second series 27 of fifty holes O each having a diameter of 20 μm. The first series 28 of fifty holes O generates a spray of small droplets having a size-distribution curve that presents a peak formed by a Gaussian distribution that is relatively narrow, while the second series 27 of fifty holes O generates a spray of bigger droplets having a size-distribution curve that also presents a peak formed by a Gaussian distribution that is relatively narrow, but that is offset and distinct from the first Gaussian distribution of the series 28. A spray is thus obtained with two droplet sizes that correspond to the two Gaussian size-distribution curves.

The shares between the series 27 and 28 may vary over the range 10% to 90%, with a minimum of five holes O per series. The hole size of the series 27 may vary over the range 15 μm to 50 μm, while the hole size of the series 28 may vary over the range 5 μm to 20 μm, with the size of the series 27 always being significantly greater, by at least about 30%, than the size of the series 28.

Figure 6:
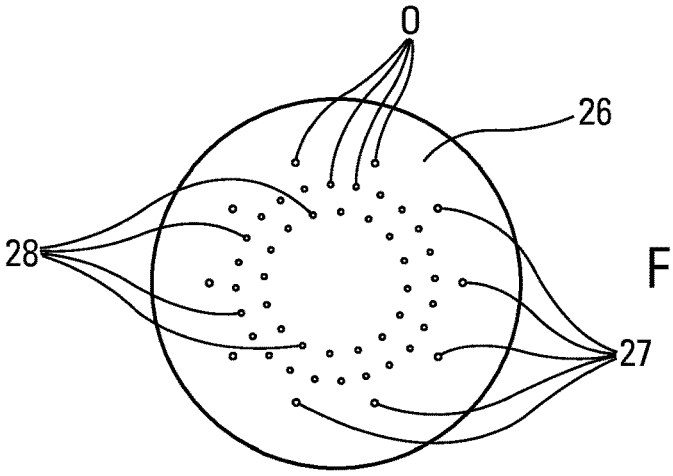
FIGS. 6 to 13 are front views on a much larger scale of the spray wall of the nozzle in FIGS. 4 and 5 in eight embodiments of the invention.

FIG. 6 shows the visible portion of the spray wall 26 of the dispenser head T in FIGS. 1 to 5. It should be observed that it includes a first series 27 of ten holes O that present a size or a diameter that is significantly greater than the forty holes O of a second series 28. The first series 27 forms a ring that surrounds two other rings that form the series 28. The configuration is generally concentric. The spray wall 26 may be used to spray perfume onto a user's body. The diameter of the holes of the first series 27 may lie in the range about 15 μm to 30 μm, and the diameter of the holes of the second series 28 may lie in the range about 5 μm to 15 μm. In this way, it is possible to optimize the wetness perception of the perfume when it is deposited on the skin by means of the spray coming from the first series 27, and to optimize the olfactory perception of the perfume by means of the spray coming from the first series 28. In addition, by arranging the series 27 around the series 28, the smaller droplets of the series 28 are surrounded, channeled, and guided by the bigger droplets coming from the series 27. In this way, the smaller droplets are prevented from dispersing too much and creating turbulence.

Figure 7:
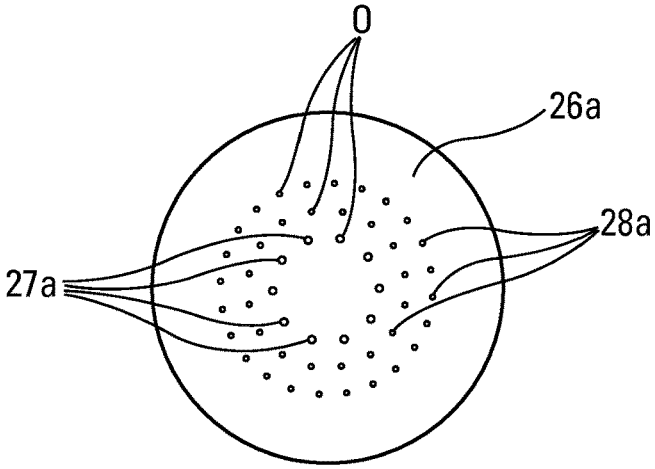

FIG. 7 shows a spray wall 26*a* that presents a reverse arrangement, with the series 27*a* of greater diameter surrounded by two rings of small holes forming a series 28*a* of smaller diameter. In this way, a spray is obtained with a dense central core surrounded by a cloud of vapor. With perfume, preference is given to the olfactory aspect, while nevertheless guaranteeing the wet feel aspect.

Figure 8:
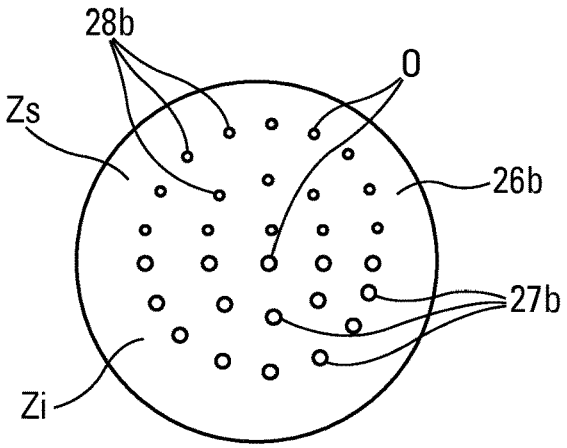

FIG. 8 shows a spray wall 26*b* that defines two distinct zones, namely an upper zone Zs and a lower zone Zi that are separated by a horizontal mid-line. The greater-diameter holes O of the series 27*b* occupy the lower zone Zi, while the smaller-diameter holes O of the series 28*b* occupy the upper zone Zs. Both series 27*b* and 28*b* present a configuration that is semi-circular, and they co-operate with each other to form a complete disk. With this arrangement, the cloud of vapor coming from the holes O of the series 28*b* disperse rapidly into the air and are immediately perceived by the user's sense of smell, because in general the perfume is directed at a target situated below the nose.

Figure 9:
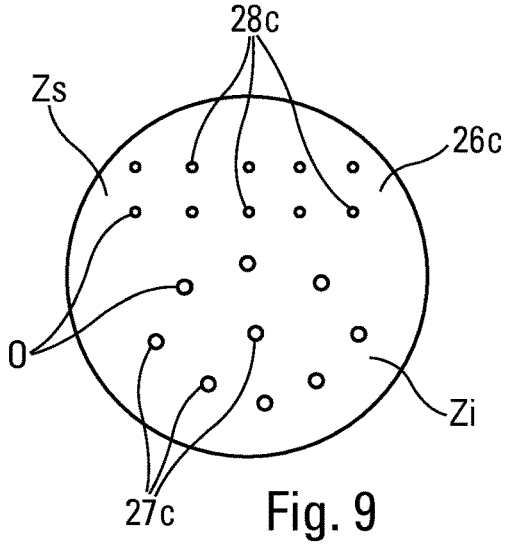

FIG. 9 shows a spray wall 26*c* with a greater-diameter series 27*c* occupying the lower zone Zi and arranged in a disk shape, and with the smaller-diameter series 28*c* occupying the upper zone Zs and arranged in an elongate rectangle. The resulting spray is even more complex than that described above.

Figure 10:
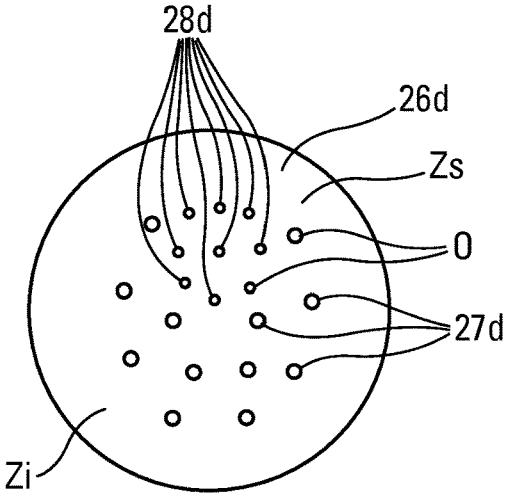

FIG. 10 shows a spray wall 26*d* with a greater-diameter series 27*d* occupying both the lower zone Zi and also a portion of the upper zone ZS and arranged in the shape of a crescent, and the smaller-diameter series 28*d* occupying the upper zone Zs and arranged in a disk shape inside the crescent shape of the series 27*d*. For perfume, the wet aspect is enhanced with an olfactory aspect that is channeled, but nevertheless directed upwards.

Figure 11:
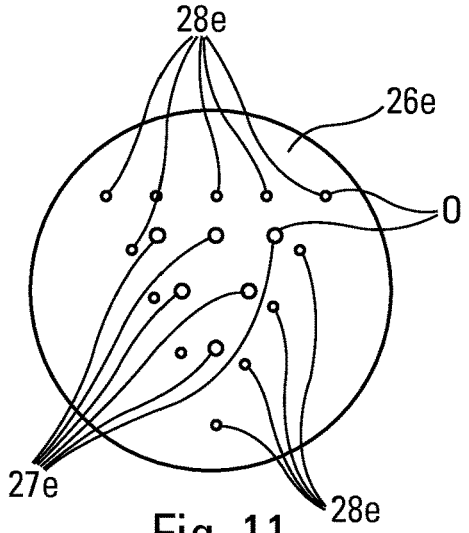

FIG. 11 shows a spray wall 26*e* with a greater-diameter series 27*e* arranged in a triangle surrounded by a smaller-diameter series 28*e* also arranged in a triangle around the series 27*e*. It should be observed that the triangle points downwards, so that the majority of small holes O of the series 28*e* are arranged in the upper zone of the wall.

Figure 12:
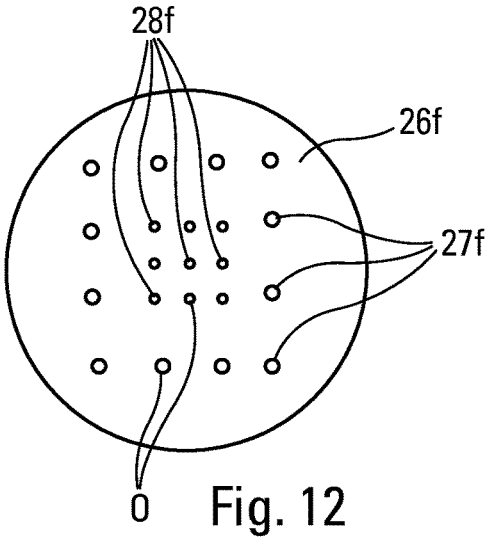

FIG. 12 shows a spray wall 26*f* with a greater-diameter series 27*f* arranged in a square surrounding a smaller-diameter series 28*f* inside the series 27*f* and also arranged in a square. A spray is obtained that is substantially comparable in performance to the spray of the spray wall 26 in FIG. 6.

Figure 13:
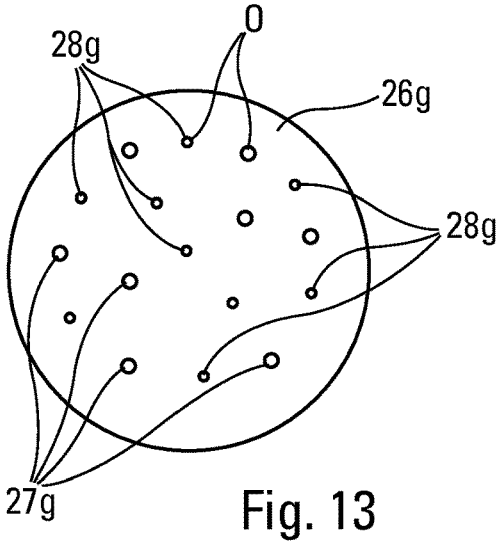

FIG. 13 shows a spray wall 26*g* with a greater-diameter series 27*g* dispersed in a smaller-diameter series 28*g*. The holes O of different sizes are mixed together and distributed in substantially uniform manner.

Without going beyond the ambit of the invention, spray walls may be made including more than two series of holes. Starting from FIG. 7, it is quite possible to imagine that the intermediate ring presents a hole size that is different from the hole sizes of the outer and inner rings.

The number of series of holes, the number of holes per series, the arrangement of the holes in the spray wall, and the size or diameter of the holes are all parameters that make it possible to determine the number of Gaussian distributions, the peak value of each Gaussian distribution, and the structure of the spray. The parameters should be determined as a function of the fluid to be sprayed and of the multiple functions that are desired: tactile and olfactory for fluids containing fragrances—penetration to various depths in the respiratory system for a fluid to be inhaled—accurate and controlled density gradation on an application surface.

The invention claimed is:

1. A fluid dispenser for application of a sprayed fluid to a user's skin, comprising a dispenser member (P) and a fluid dispenser head (T) including a spray wall that is perforated with a network of holes (O) through which a fluid under pressure passes so as to be sprayed in small droplets, the dispenser member configured to generate pressure on the fluid lying in the range of 2 bars to 13 bars;

wherein the network of holes (O) comprises at least two series of holes (O), with the holes (O) of a given series presenting holes that are same in size, and with the holes (O) of different series presenting holes that are different in size from the size of the holes in the given series, such that one series of holes (O) is configured to generate a spray of small droplets with droplet sizes that follow a first Gaussian distribution, while another series of holes (O) generates a spray of small droplets with droplet sizes that follow a second Gaussian distribution that is offset relative to the first Gaussian distribution, thus producing a complex spray having at least two distinct Gaussian distributions; and wherein the size of the holes of the two series of holes lies in the range of 5 μm to 30 μm.

2. A dispenser according to claim 1, wherein a series of holes (O) of larger size is arranged around a series of holes (O) of smaller size.

3. A dispenser according to claim 1, wherein a series of holes (O) of smaller size is arranged around a series of holes (O) of larger size.

4. A dispenser according to claim 1, wherein the series of holes (O) are arranged in concentric rings.

5. A dispenser according to claim 1, wherein the series of holes (O) present a geometric arrangement.

6. A dispenser according to claim 1, wherein the spray wall defines an upper zone (Zs) and a lower zone (Zi), the series of smaller-size holes (O) extends mainly in the upper zone (Zs), while the series of larger-size holes (O) extends mainly in the lower zone (Zi).

7. A dispenser according to claim 1, wherein the series of holes (O) are interleaved in substantially uniform manner.

8. A dispenser according to claim 1, wherein each series of holes (O) comprises at least five holes (O) that are same in size.

9. A dispenser according to claim 1, wherein the sizes of the holes (O) of different series differ by at least 30%.

10. A dispenser according to claim 1, wherein the size of the holes (O) of the series of holes (O) lies in the range of 1 μm to 100 μm.

11. A dispenser according to claim 9, wherein the size of the holes (O) of the series of smaller-size holes (O) lies in the range 5 μm to 15 μm, and the size of the holes (O) of the series of larger-size holes (O) lies in the range 15 μm to 30 μm, in particular for spraying fluid that contains a fragrance.

12. A dispenser according to claim 1, wherein the fluid dispenser head comprises:

an inlet well for connecting to an outlet of the dispenser member;

an axial assembly housing;

a feed duct that connects the inlet well to the axial assembly housing; and a nozzle including an assembly wall that is engaged in the axial assembly housing, the spray wall being secured to the nozzle.

13. A dispenser according to claim 12, wherein the assembly wall is overmolded on the spray wall.

14. A dispenser according to claim 1, wherein the dispenser member is a pump (P), configured to generate internal pressure on the fluid lying in the range of 2 bars to 7 bars.

15. A dispenser according to claim 1, wherein the dispenser member is a valve, configured to generate internal pressure on the fluid lying in the range of 6 bars to 13 bars.

16. The dispenser according to claim 1, wherein the dispenser member is a pump or a valve.

17. The dispenser according to claim 1, wherein the size of the holes of the series of holes lies in the range of 10 μm to 20 μm.

18. A dispenser assembly, comprising a dispenser according to claim 1 mounted on a reservoir containing fluid that, when the dispenser is actuated, passes under pressure so as to be sprayed in small droplets with the droplet sizes that follow the first Gaussian distribution and the droplet sizes that follow the second Gaussian distribution.

19. The dispenser according to claim 1, wherein the spray wall is made of plastics material.

20. The dispenser according to claim 1, wherein the fluid dispenser is configured to be manually actuated by depressing the dispenser head.

21. A fluid dispenser system comprising the fluid dispenser according to claim 1 and a fluid reservoir on which the dispenser member is mounted, wherein the fluid reservoir contains a perfume, and wherein the dispenser member is a pump or a valve.

22. A fluid dispenser system, comprising a fluid dispenser, comprising a dispenser member (P) and a fluid dispenser head (T) including a spray wall that is perforated with a network of holes (O) through which a fluid under pressure passes so as to be sprayed in small droplets, the dispenser member configured to generate pressure on the fluid lying in the range of 2 bars to 13 bars; and a fluid reservoir on which the dispenser member is mounted;

wherein the network of holes (O) comprises at least two series of holes (O), with the holes (O) of a given series presenting holes that are same in size, and with the holes (O) of different series presenting holes that are different in size from the size of the holes in the given series, such that one series of holes (O) is configured to generate a spray of small droplets with droplet sizes that follow a first Gaussian distribution, while another series of holes (O) generates a spray of small droplets with droplet sizes that follow a second Gaussian distribution that is offset relative to the first Gaussian distribution, thus producing a complex spray having at least two distinct Gaussian distributions; and wherein the fluid reservoir contains a perfume or pharmaceutical, and wherein the dispenser member is a pump or a valve;

wherein the size of the holes of the two series of holes lies in the range of 5 μm to 30 μm; and wherein the dispenser member is a pump configured to generate internal pressure on the fluid lying in the range of 2 bars to 7 bars.

23. A fluid dispenser system, comprising a fluid dispenser, comprising a dispenser member (P) and a fluid dispenser head (T) including a spray wall that is perforated with a network of holes (O) through which a fluid under pressure passes so as to be sprayed in small droplets, the dispenser member configured to generate pressure on the fluid lying in the range of 2 bars to 13 bars; and a fluid reservoir on which the dispenser member is mounted;

wherein the network of holes (O) comprises at least two series of holes (O), with the holes (O) of a given series presenting holes that are same in size, and with the holes (O) of different series presenting holes that are different in size from the size of the holes in the given series, such that one series of holes (O) is configured to generate a spray of small droplets with droplet sizes that follow a first Gaussian distribution, while another series of holes (O) generates a spray of small droplets with droplet sizes that follow a second Gaussian distribution that is offset relative to the first Gaussian distribution, thus producing a complex spray having at least two distinct Gaussian distributions;

wherein the fluid reservoir contains a perfume or pharmaceutical, and wherein the dispenser member is a pump or a valve;

wherein the size of the holes of the series of holes lies in the range of 5 μm to 30 μm; and wherein the dispenser member is a valve, configured to generate internal pressure on the fluid lying in the range of 6 bars to 13 bars.

* * * * *